United States Patent [19]

Tinley

[11] Patent Number: 4,893,224

[45] Date of Patent: Jan. 9, 1990

[54] EMERGENCY LIGHTING FIXTURE

[75] Inventor: Raymond K. Tinley, Mt. Prospect, Ill.

[73] Assignee: Cooper Industries, Houston, Tex.

[21] Appl. No.: 286,821

[22] Filed: Dec. 20, 1988

[51] Int. Cl.[4] ..... F21V 21/28

[52] U.S. Cl. ..... 362/287; 362/288; 362/372; 362/419

[58] Field of Search ..... 362/368, 372, 363, 418, 362/419, 427, 285, 287, 288, 376

[56] References Cited

U.S. PATENT DOCUMENTS

| | | | |
|---|---|---|---|
| 859,403 | 7/1907 | Miesse | 362/363 |
| 1,791,697 | 2/1931 | Amen | 362/372 |
| 2,249,357 | 7/1941 | Graham | 362/372 |
| 3,290,497 | 12/1966 | Ragle et al. | 362/376 |
| 4,245,281 | 1/1981 | Ziayler, Jr. | 362/372 |
| 4,352,151 | 9/1982 | Lewis | 362/372 |

FOREIGN PATENT DOCUMENTS

| | | | |
|---|---|---|---|
| 577287 | 6/1959 | Canada | 362/376 |

*Primary Examiner*—Ira S. Lazarus
*Assistant Examiner*—Richard R. Cole
*Attorney, Agent, or Firm*—Kenyon & Kenyon

[57] ABSTRACT

The disclosure relates to lighting fixtures permanently installed which provide for adjustment in light source direction. The apparatus includes a housing of a dome configuration within which a lens and light reflector assembly is mounted for relative rotational movement. A ratchet mechanism is employed to lock this assembly into the desired orientation. A portion of the adjustment mechanism is exposed for operation by the user.

14 Claims, 1 Drawing Sheet

EMERGENCY LIGHTING FIXTURE

BACKGROUND OF THE INVENTION

This invention relates to lighting fixtures and particularly to emergency lighting fixtures that are permanently installed and used in hospitals, office buildings and other public establishments which are required by safety codes to light a path of egress when there is power failure. Fixtures of the kind currently installed in such facilities include a protective housing which, e.g., may be explosion proof or otherwise capable of protecting the emergency lamp from the elements or other external forces and a reflector or other light beam providing device for directing the emergency light to a fixed location. That is, emergency lighting fixtures currently in use direct light to fixed locations or paths of egress. Many fixtures presently available utilize adjustment mechanisms to ensure that the light is properly directed. Such mechanism can be awkward, obtrusive and limited in function.

The invention described herein overcomes problems associated with the lighting fixtures noted above by providing an adjustability mechanism that is simple, easy to operate, dependable and economical. The source is provided with an additional protective plastic housing which also serves as a functional element in the adjustment mechanism. The appearance of the fixture is enhanced since obtrusive parts are eliminated.

Existing devices that have adjustment mechanisms require significant time and effort to make the required adjustment of the light source and include a separate locking mechanism to secure the light in the proper position. Such lighting fixtures are relatively complex having a number of interacting parts, which also makes them expensive to manufacture. In this invention a means is provided for adjusting a light source that is enclosed within a clear plastic housing (dome). This adjustment can be made from a position outside the housing and once adjusted will stay in place without an additional locking mechanism.

In the invention, as more fully described in the detailed description of the preferred embodiment, a structure is pivotally arranged within a housing with a portion exposed for access by the user. By rotation this exposed portion the fixture can be adjusted to the desired position where it will be maintained until readjusted by the user. The adjusting mechanism is generally flush with the exterior surface to create a smooth uninterrupted surface to the viewer.

The above has been a brief discussion of some of the deficiencies in the prior art and advantages of the invention. Other advantages will be apparent from the detailed description of the preferred embodiment which follows.

DESCRIPTION OF THE PREFERRED EMBODIMENT

Figure 1:
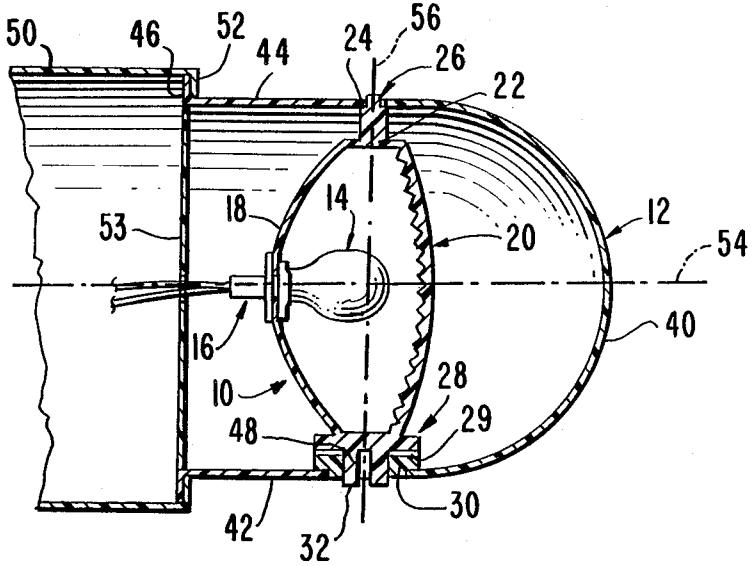
FIG. 1 is a side elevation showing a beam forming lamp assembly and mounting for rotating the assembly.
Figure 2:
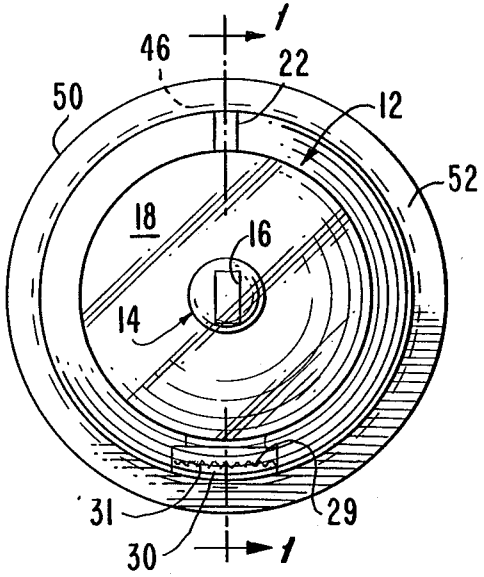
FIG. 2 is a front view of the lamp shown in FIG. 1.

In the preferred embodiment of the invention, a lamp assembly 10 is mounted for pivotal movement inside a dome 12 made of clear flexible, resilient plastic material. The assembly includes a lamp 14 supported in a socket 16 which may be energized in the normal fashion through leads connected to a source of electricity. Socket 16 is mounted in and supported by a reflector 18, generally in the center and spaced from lens 20. The internal surface of reflector 18 is concave such that light emanating from lamp 14 may be focused through a lens 20 and directed as a beam through dome 12.

Dome 12 has two portions, a cylindrical portion 42 which extends rearwardly from hemispherical portion 40. Sidewall 44 of cylindrical portion 42 is tangential to hemispherical portion 40 and has the same radius of curvature. At a position distal from the intersection between portions 40 and 42, a flange 46 extends radially outwardly from sidewall 44. This assembly permits attachment to some other support structure where the emergency light will be used.

In this embodiment the support structure 50 includes annular lip 52 that overlaps flange 46 to hold housing 12 in place. A backwall 53 of structure 50 is spaced from lip 52 to form annular groove to receive flange 46 therein and permit relative rotational movement of housing 12 about longitudinal axis 54. This arrangement with the adjustment mechanism described below permits universal adjustment of lamp assemble 10.

In the preferred embodiment reflector 18 is provided with a cylindrically shaped projection or extender 22 to which the lens may be permanently or removably attached. Boss or bearing 26 fixed to the end of extender 22 extends through aperture 24 in sidewall 44. Aperture 24 is slightly larger than bearing 26 but smaller than the cross-section of extender 22. This arrangement permits relative rotational movement for adjustment while maintaining the proper orientation of lens 20 within dome 12 once adjustment is completed.

A ratchet member or gear 28 is affixed to and located at a position of the assembly opposite support member 22 for rotational movement within a second ratchet or gear 30 operating as a pawl and fixedly mounted on the interior of the dome 12. The member 28 is provided with a projection 32 communicating with the exterior of the dome 12 such that a turning motion may be imparted to the member from outside the dome. A slot 48 is formed in the exterior surface of the projection or post 32 in order to receive a coin screwdriver or other means to turn the ratchet 28.

It should be noted that projection 32 is substantially flush in that the exposed surface is coplanar with cylindrical portion 42. This produces a relatively smooth exterior surface visible to the observer. Dome 12 completely surrounds lens 20 to provide additional protection to the apparatus during emergency.

Specifically, as can be seen in FIG. 1, ratchet assembly includes a first rotatable member 28 fixed to lens 20 and a second fixed member 30 with journal 48, fixed to sidewall 44 as shown. Member 28 includes post 32 which extends through journal 48 and is exposed on the exterior sidewall 44 for operation by the user. Rotatable member 28 has ratchet teeth 29 arranged annularly about post 32. Fixed member 30 includes complementary set of ratchet teeth 31 arranged annularly about journal 48 for engagement with teeth 29 of member 28. The two members 28 and 30 are biased into engagement in locked position by the flexible dome 12. Post 32 can be displaced against this bias to disengage the members 28 and 30 and permit relative rotation.

As explained above plastic lens 20 is maintained generally in a locked position under the bias imposed on members 28 and 30 by dome 12. To adjust the angle of lens 20, a tool is inserted into slot 48, and post 32 is displaced sufficiently to disengage ratchet teeth of their respective members. This plastic dome 12 will flex to accommodate this displacement. Post 32 is then rotated until lens 20 is oriented to the desired position. Once the proper orientation is reached, the tool is removed and the post 32 will retract under the bias of dome 12 to a locked position where the teeth are in interengagement. This provides adjustment about the axis 56 defined by the bearing 26 and post 32. Further orientation can be made by rotating housing 12 about longitudinal axis 54. In this way universal adjustment of lamp assembly 10 is obtained.

It will be appreciated by those skilled in the art that the shapes of the various supporting members may be altered such that additional turning angles may be provided for the emergency light should that be desired. For example, while the ratchet members are portrayed with plane or flat surfaces, it should be apparent that curved surfaces could be substituted. In addition the shape of the dome might be some other shape than that portrayed in the drawing.

The full scope of the invention is defined in the claims which follow and their equivalents. In this regard the specification should not be interpreted to unduly narrow the scope of invention as defined in the claims and to which the inventor is otherwise entitled.

What is claimed is:

1. An apparatus for adjusting the position of a light source comprising:

(a) a light source supporting structure;

(b) a housing; said support structure arranged for relative rotative movement within said housing;

(c) means for adjusting the position of said structure within said housing; said means including a rotatable member fixed to said structure and a fixed member fixed to said housing; said members being movable between a locked and unlocked position wherein in said locked position said members interengage to prohibit relative movement between said members and in said unlocked position said members can be rotated relative to each other; and (d) said means for adjusting the position of said structure including a portion of said fixed member extending beyond said housing for operation by a user.

2. The apparatus according to claim 1 further comprising means for biasing said members into said locked position.

3. The apparatus according to claim 2 wherein said housing is made of resilient material; and said means for biasing said members includes at least a portion of said housing.

4. The apparatus according to claim 3 wherein said moveable member fixed to said support structure includes a first set of ratchet teeth and said fixed member fixed to a portion of said housing has a complementary set of ratchet teeth for interengagement with said first set of ratchet teeth on said moveable member.

5. The apparatus according to claim 4 wherein said movable member includes a post extending therefrom, said post defining an axis for rotation of said moveable member, said fixed member includes a journal for receiving said post, said post extending through said journal and said housing is exposed for operation by user.

6. The apparatus according to claim 5 wherein said post further includes a slot for engagement by a tool to rotate said post.

7. The apparatus according to claim 6 wherein said support structure includes a lens, a reflector for supporting the light source displaced from said lens and reflecting the light toward said lens.

8. The apparatus according to claim 7 further comprising an extended portion fixed to said lens and pivotally engaged with said housing, said extended portion being located at a position remote from said moveable member.

9. The apparatus according to claim 8 wherein said housing includes a dome portion and a cylindrical portion extending therefrom, said structure being rotatably secured to said cylindrical portion.

10. The apparatus according to claim 9 wherein said housing is made from a clear plastic material.

11. The apparatus according to claim 10 wherein said housing is rotatable about a longitudinal axis perpendicular to said axis defined by said post.

12. The apparatus according to claim 11 further comprising a housing supporting means for supporting said housing and permitting relative rotation therewith.

13. The apparatus according to claim 12 wherein said housing includes a flange extending radially therefrom, and said means for supporting said housing includes a lip overlapping said flange for holding said housing in relative rotation therewith.

14. An apparatus for adjusting the position of a light source comprising:

(a) a lens;

(b) a reflector having a concave surface relative to said reflector and fixed to said lens;

(c) a lamp fixed to said reflector in spaced relationship to said lens;

(d) said reflector and said lens forming a lamp assembly;

(e) a housing made of resilient clear material, said housing cooperating with said lamp assembly to permit relative rotation therewith, and said housing being mounted against a surface of a support structure;

(f) means for rotating said assembly within said housing from a position outside of said housing, said means including a post extending from said assembly and defining an axis for rotation of said assembly, a journal member fixed to said housing and configured for receiving said post in a relative rotation therewith, said post extending beyond said housing for access by a user; and (g) wherein said housing is rotatable about a longitudinal axis perpendicular to said axis defined by said post and perpendicular to said surface.

* * * * *